US008712612B2

(12) United States Patent
Beaurent et al.

(10) Patent No.: US 8,712,612 B2
(45) Date of Patent: Apr. 29, 2014

(54) SYSTEM FOR DETERMINING MOVEMENT PROPERTIES OF A GUIDED VEHICLE

(75) Inventors: Pierre Joseph Beaurent, St. Rémy les Chèvreuses (FR); Nicolas Cravoisy, Asniéres sur Seine (FR); Philippe Forin, Guyancourt (FR); Norbert Pfeifer, Arpajon (FR)

(73) Assignee: Siemens S.A.S., St. Denis (FR)

( * ) Notice: Subject to any disclaimer, the term of this patent is extended or adjusted under 35 U.S.C. 154(b) by 525 days.

(21) Appl. No.: 13/054,597

(22) PCT Filed: Jul. 16, 2008

(86) PCT No.: PCT/FR2008/001048

§ 371 (c)(1),
(2), (4) Date: Jan. 18, 2011

(87) PCT Pub. No.: WO2010/007217

PCT Pub. Date: Jan. 21, 2010

(65) Prior Publication Data

US 2011/0130899 A1 Jun. 2, 2011

(51) Int. Cl.
*B61L 25/00* (2006.01)

(52) U.S. Cl.
USPC ..... 701/19; 342/44

(58) Field of Classification Search
USPC ..... 701/19, 117, 1, 20; 340/993; 342/44; 246/2 R, 27, 28 R
See application file for complete search history.

(56) References Cited

U.S. PATENT DOCUMENTS

| | | | | |
|---|---|---|---|---|
| 6,511,023 | B2 * | 1/2003 | Harland | 246/122 R |
| 6,694,231 | B1 | 2/2004 | Rezk | |
| 6,799,099 | B2 * | 9/2004 | Zeitler et al. | 701/23 |
| 7,551,082 | B2 * | 6/2009 | Vishik et al. | 340/572.1 |
| 7,826,938 | B2 * | 11/2010 | Kato et al. | 701/19 |
| 2001/0022332 | A1 | 9/2001 | Harland | |
| 2004/0030466 | A1 | 2/2004 | Rezk | |
| 2006/0197939 | A1 | 9/2006 | Baiker et al. | |
| 2007/0146159 | A1 | 6/2007 | Kato et al. | |

FOREIGN PATENT DOCUMENTS

| | | | |
|---|---|---|---|
| CN | 1599270 | A | 3/2005 |
| DE | 3134766 | A1 | 3/1983 |
| DE | 10131585 | A1 | 6/2002 |
| EP | 1388480 | A1 | 2/2004 |
| EP | 1701287 | A1 | 9/2006 |

* cited by examiner

*Primary Examiner* — Dalena Tran
(74) *Attorney, Agent, or Firm* — Laurence A. Greenberg; Werner H. Stemer; Ralph E. Locher

(57) ABSTRACT

A system for determining the movement properties of a guided vehicle along a section adapted for a lane signaling control. The vehicle includes at least four onboard transponders that are arranged in pairs. The two transponders of each pair are aligned in parallel to the longitudinal axis of the vehicle, with at least one pair downstream and at least one pair upstream from the vehicle, and providing distinct identification means. At least one transponder reader is provided on the ground at each end of the section. A ground calculator communicates with the readers and determines, upon the passage of at least two transponders of a vehicle, a driving direction and a front/rear intrinsic orientation of the vehicle relative to the lane.

13 Claims, 3 Drawing Sheets

SYSTEM FOR DETERMINING MOVEMENT PROPERTIES OF A GUIDED VEHICLE

BACKGROUND OF THE INVENTION

Field of the Invention

This invention concerns a system for determining the movement properties of at least one vehicle guided along a section (area of transportation comprising several guiding tracks) appropriate for a signaling control of tracks.

As a vehicle, one must understand public transit means such as bus, trolleybus, tramway, subway, train or train units, etc. In particular, units of automatic trains with guiding control (technique also commonly called "CBTC"="communication based train control") are aimed at by the invention. These generally comprise vehicles communicating with on-board guiding equipments and (remote-) controlled by ground automatic devices (signalling, central calculator, etc). An example of achievement of such vehicles is known with, among others, registered brands like VAL, AIRVAL, CITYVAL, NEOVAL for which units of trains comprise at least one traction wheel/roller-based device on a guiding rail longitudinally central on a train track and side pneumatic tired wheels, carrying said units on longitudinal concrete-strips on each side of the track.

First, determining the presence properties of a vehicle guided along a section is known under several forms:

a) The traditional solution, which applies to tracks made of two iron rails, consists in installing a "circuit of track" (also in abbreviated form under the diminutive "CoT" afterwards) on each (track of) section: said CoT is made up of an electrical conductor component on-board and electrically connecting the two rails (for example with a signal transmitter-receiver to the section ends) and enables to know the state of occupancy of the section. Generally, the CoT for example can be installed through an iron axle. If this electrical conductor establishes a short circuit between the rails on a section, the CoT of the section is in "off" state and the section is declared occupied by the vehicle. If no short circuit is detected, the CoT is in "on" state and the section is free of vehicle.

When one or several trains are present on the section, each axle thus establishes a short circuit between the two rails, which maintains the CoT in "off" state. As soon as all the axles of the present train or of the present trains have left the section, said section switches to the free state whatever the sequence of arrival or of departure of the trains is. So the CoT does not give the exact number (greater than 1) of vehicles present on a section.

However, safety is nevertheless ensured insofar as almost all the failures of a CoT have the same effect as a short circuit between the rails: the CoT indeed stays in "off" state in case of a failure.

The main drawback of CoT lies also in their high cost.

b) Another solution is the following: when the tracks are not made up of rails (conductors), for example for most subways and tramways equipped with pneumatic tired wheels, other solutions exist and are used:

For systems of CBTC type, each train (or vehicle) is equipped of a calculator, positions itself continuously on the network and transmits permanently its position to a ground calculator or to ground calculators that determine(s) the state of each section. "Negative detectors" (luminous or ultrasound-emitting fences for example) placed at the borders of the system enable to safely detect the arrival of a "mute" train in the network.

Devices located under the trains permanently emit a fixed frequency signal that is picked up by ground receivers associated with receiving loops (antennas) located in the track. Said devices can be associated with negative fences placed in specific points. A ground calculator or ground calculators, connected to the receivers, determine(s) the state of occupancy of each section according to the detection or not of a signal by each receiver. Safety is so ensured either by redundancy of the emitters and of the receivers, or, if the receiving loops cover continuously all the tracks, by controlling that each train emits continuously and by forbidding the arrival of a train in a section already occupied.

In those two last cases (a and b), if the trains do unexpected or non authorized movements (in particular backward movements or the penetration of a train in a section already occupied), the concerned sections stay frequently and inevitably in the "occupied" state even if there is no train in it. This is very disadvantageous to reach a high efficiency of management and of automated manoeuvres of the vehicles.

c) A document US 2004/0030466 A1 ("train registry overlay system") finally describes a method for determining presence properties of a vehicle guided along a section. To ensure a backup (save procedure) in case of failure to the CBTC systems without using any CoT because of its cost, a transponder fixed on each vehicle/unit of trains contains an identifier. Trans-ponder readers placed along the tracks extract these identifiers while the trains go past and pass them on to a ground calculator which uses them to determine the occupancy of the tracks.

Safety can be increased by a redundancy of the on-board transponders, of the transponder readers and of the calculators.

However, if this device indeed enables to identify all the trains present in the CBTC system, it does not enable to determine the movement properties of a vehicle, in particular if said vehicle goes in or goes out of a section. In other words, a set transponder/reader cannot deliver a vehicle moving direction. Furthermore, the intrinsic orientation of the vehicle (its front and its rear) in comparison with the track stays unknown too. This aspect is also disadvantageous from an information point of view regarding the CBTC automatisms, in particular to determine the moving direction of the vehicle in comparison with the track, while according to the topology of the track, during its running, it has the possibility to turn around.

In particular, if a vehicle has not been yet identified, it is not possible to know, during its going past a first transponder located on a border between a first and a second section, if it goes out of the first section and goes in the second section or the reverse.

Likewise, if a vehicle already identified stops with its transponder located in front of the transponder reader, it is not possible to determine, when it restarts, if it is going towards a section located upstream of the transponder or towards a section located downstream of the transponder: no one of the two can then be "freed", in the sense that automatic protections forbid another vehicle to access the section free in reality. These lines-blocked highly penalize the traffic of trains.

BRIEF SUMMARY OF THE INVENTION

One goal of the present invention is to offer a system for determining the movement properties of at least one guided vehicle along a section for which, in particular, the knowledge of the moving direction of vehicle on a border between two sections is precisely ensured. A second goal of the invention is, if necessary, linked to the knowledge of the intrinsic "front/rear" orientation of the vehicle in comparison with a section track. This last orientation aspect will also be more simply called "polarity" afterwards in the document.

Depending on the equipments of vehicles and on the knowledge possible or not of the vehicle polarity, in particular for equipments of CBTC type or for non equipped vehicles, the invention thus offers two achievement modes of systems appropriate for those two possibilities real indeed while staying within an unitary frame for determining movement properties of vehicles of all type. Those two modes are described by the claims.

A set of sub-claims also presents advantages of the invention.

The invention thus offers a first mode of achievement of a system for determining the movement properties of vehicle guided along a section appropriate for a signalling control of tracks, for which:

the vehicle comprises at least four on-board transponders, placed in pairs, the two transponders of each pair being aligned in a parallel to the vehicle longitudinal axis, at least a pair downstream and at least a pair upstream of the vehicle and delivering distinct identification means, at least one transponder reader is placed on the ground at each end of the section, a ground calculator is communicating with the readers and determines, during the going past of at least two transponders of a vehicle, a moving direction and an intrinsic orientation front/rear of the vehicle in comparison with the track (polarity).

The two pairs of transponders being aligned in a parallel to the train moving axis, one at the front and the other at the rear of each train, each transponder contains at least an only identifier of its absolute position on the train and optionally an identifier of the train (like in the state of the art).

One or two transponder readers and their antennas are located at the limits of each section and so can extract the identification information contained in the transponders and transmit them to the ground calculator in the order they have been read, which enables the calculator to determine the moving direction, the polarity in an only and precise way and from what section it is going out and what section it is going in. This is a major aspect to avoid blocking uselessly a section which is free in reality for another vehicle.

At least one calculator is connected to the transponder readers of each independent zone of detection of the trains, each zone containing one or several tracks divided in one or several sections.

In some cases, it is possible that the polarity of vehicles is known to the calculator (that is the "front" and the "rear" of each train in comparison with the track are known, regardless of the traffic direction), so it is possible to determine, as soon as two transponders of a train end have gone past a reader:

in what moving direction runs the train, from what section it is going out and what section it is going in.

In other cases, the polarity of the vehicles is not known to the ground calculator and determining a vehicle polarity is necessary.

When the polarity of a train (as a vehicle) is unknown to the calculator, the system according the invention then enables to determine it in several ways, for example:

by adding a second row of transponders at the front and at the rear of the trains, symmetrical to the first one in comparison with the train axis, and by placing antennas of readers asymmetrically in comparison with the track axis, so that only the transponders from the "right" (right side of the vehicle) are read when the polarity is "positive" and that only the transponders from the "left" (left side of the vehicle) are read when the polarity is "negative". The polarity of the train is then known from the reading of a first transponder thanks to its identifier of position on the train.

by waiting that a transponder goes past two readers successively placed along the track, which enables to determine both the moving direction of the train and its polarity.

The two successive readers can be either two readers framing any section, but the train has then to cover a whole section before its polarity can be known, or a first reader already present by the border of each zone and a second reader that is placed close to said first reader, so by the zone border too, but longitudinally shifted on the track. The polarity of the trains is then advantageously and immediately determined as soon as they go in a zone.

The pairs of transponders can be placed several ways on/in the vehicle according to the number of reader(s) used at one section end. The simplest and cheapest solution is to minimize the number of readers even if it means increasing the number of transponders which are generally simple passive electronic tags with an only identifier also known under the name RFID or TAG, and able to be activated by the reader in a perimeter specified to said reader in order to communicate the only identifier to the reader. That way, if only one reader is placed at one section end, the pairs of transponders can be placed with versatility alongside a vehicle or diagonally in comparison with a longitudinal axis of a vehicle moving, in order to ensure a reading whatever the moving direction and the polarity of the vehicle going past the reader are.

For each pair of transponders or for each transponder, it is advantageously possible to add at least an extra transponder being then ideally placed at the front and at the rear on the vehicle to ensure a redundant number of transponders. In case of failure of a transponder, the extra transponder and the transponder still functional ensure a reading always by pair and so a continuous safety service without traffic disruption or danger of any loss of information. If none of the transponders is failing, the quality of determination of movement properties of a vehicle supplied with transponders in redundant number will be done under a better availability of reading.

In an advantageous configuration, the reader can be placed nearby a section track and be linked to an antenna placed with a transversal shift in comparison with a longitudinal axis median of the track. Moreover, the transponders are placed with a transversal shift in comparison with the longitudinal axis median of the vehicle. This way again, only the transponders from the "right" (right side of the vehicle) are read when the polarity is "positive" and only the transponders from the "left" (left side of the vehicle) are read when the polarity is "negative". The train polarity is then determined from the reading of a first transponder, thanks to its identifier of position on the train.

As an alternative, the transponders (at least one pair) can be aligned along a longitudinal median axis of the vehicle and antennas of two readers are then advantageously placed successively along the longitudinal median axis of the vehicle nearby each end of the section.

As previously said, extra transponders can also easily be placed on the vehicle to form rows of transponders, said rows being ideally placed along each side of the vehicle at the front and at the rear of the vehicle. Ideally, common practice advocates that each row comprises two or three transponders (so a total of four or six transponders by distribution of the rows downstream and upstream of the vehicle) successively aligned along the vehicle to ends related as much to safety reasons as to an excellent availability of reading of the transponders.

A second achievement mode of the system for determining the movement properties of a vehicle guided along a section appropriate for a signalling control of tracks is also suggested in particular for a type of vehicle supplied with means for determining the moving direction and for which:

- the vehicle comprises at least two on-board transponders, each placed downstream and upstream of the vehicle and delivering predefined means of identification of the vehicle, of the front and of the rear of the vehicle,
- means for determining the moving direction intervening by a coding of the identification means of the transponders,
- at least one transponder reader is placed on the ground at one of the ends of the section,
- a ground calculator is communicating with the reader and determines during the going past of at least one transponder of the vehicle its moving direction and an intrinsic front/rear orientation of the second type of vehicle in comparison with the track.

In other words, the moving direction here is originally determined by the vehicle equipment and passed on to the ground calculator after having established a transponder coding taking in account the moving direction. These means for determining the moving direction of the vehicle are for example provided by an on-board movement calculator or by a movement measuring device.

For all the achievement modes of systems according to the invention, the transponders are simple electronic tags of "RFID" type, if necessary able to be coded for the calculator according to a parameter provided by the equipment. The codes can also be indirectly read by the calculator from a data bank wherein the RFIDs identifiers refer to information for example about the moving direction, even about the polarity.

Finally it is clear that the vehicles comprise pneumatic tired, iron or magnetic sustentation wheels. This aspect of the invention, as a consequence, makes it appropriate for any type of vehicle frame, unlike the "CoT" requiring iron rails.

Examples of achievement according to the invention are given thanks to the described figures:

DESCRIPTION OF THE INVENTION

Figure 1:
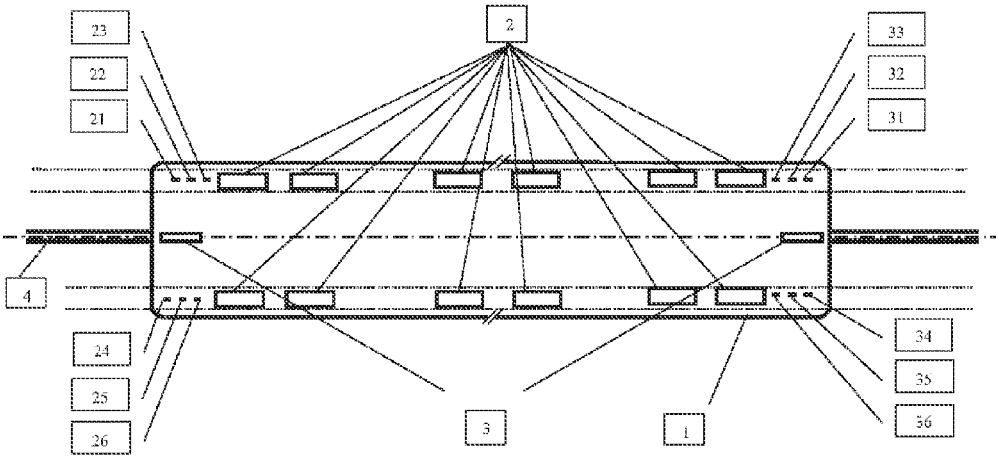
FIG. 1 First achievement mode of a system for determining the movement properties of a train (top view), FIG. 2 Same system for determining the movement properties of a train (side view), FIG. 3 Layout of readers with a shift in comparison with two parallel tracks, FIG. 4 Layout of readers and of transponders in a zone comprising two manoeuvre sections, FIG. 5 Second achievement mode of a system for determining the movement properties of a train (side view).

FIG. 1 presents the first achievement mode of a system for determining the movement properties of a vehicle 1 such as a train in top view in comparison with the track supplied with a guiding rail 4 central between two carrying tracks. The train 1 has two carrying wheels 2 equipped with tyres on each of the carrying tracks as well as guiding wheels 3 by traction inserted in the central guiding rail 4. The train 1 comprises in that example four groups of transponder triplets 21-22-23, 24-25-26, 31-32-33, 34-35-36 placed respectively at its "right front", at its "left front", at its "right rear" and at its "left rear". The words "front", "rear", "right", "left" are in no way referring to the moving direction of the train or to its polarity but are used only to indicate the groups of transponders. This system so demonstrates an advantageous redundant (or high availability) configuration by the layout of rows of three transponders at the four train ends. It could also have been possible as a minimum approach to place only a pair 21-22 at the "front" part and a pair 31-32 at the "rear" part of the train 1 and at least one reader (not shown) at the end of the section comprising the track. For clarity reasons, the ground calculator has also not been shown.

Figure 2:
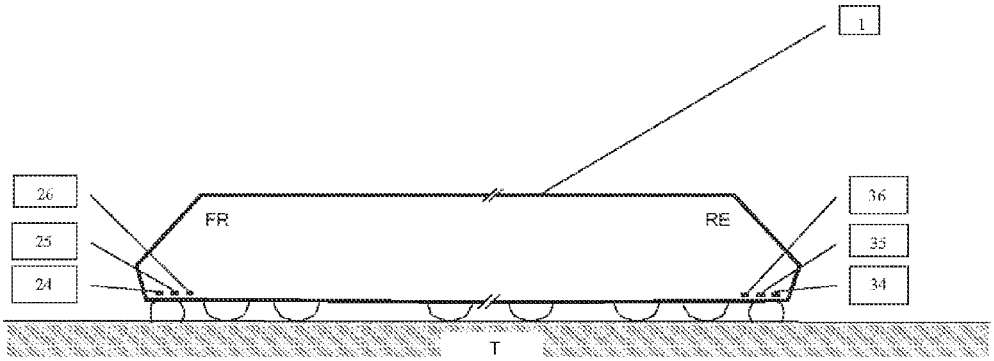

FIG. 2 is a side view of FIG. 1 illustrating the configuration of transponders 24-25-26, 34-35-36 placed under the form of two rows longitudinally in a parallel to a track T on at least one of the "front" FR and "rear" RE sides of the train 1. Thanks to this layout, the transponders can be read successively during their going past the neighbourhood of a reader. It is also obvious here that the carrying wheels are in contact with the carrying tracks slightly heightened and that two guiding wheels are fitting in the guiding rail placed a bit lower than the carrying tracks.

Figure 3:
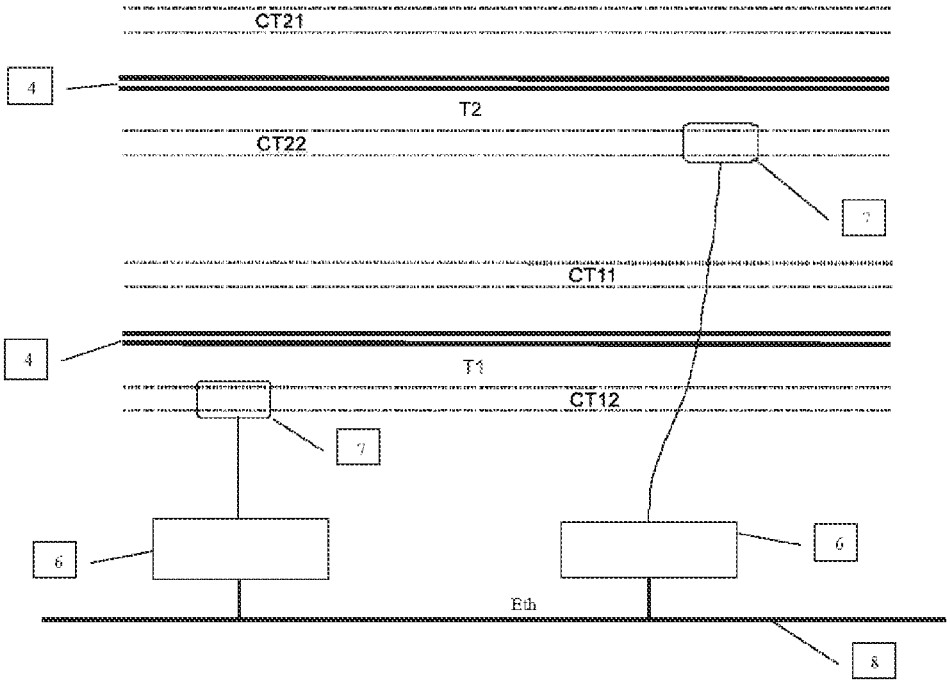

FIG. 3 presents a layout of two readers 6 distinct and with a shift in comparison with two parallel tracks T1, T2 both supplied with a central guiding track 4 and with carrying tracks CT11, CT12, CT21, CT22. This way, the reading modules of the readers 6 are out of and by the tracks and are each on the one hand connected to antennas 7 respective of the readers as well as, on the other hand, to a bus 8, Eth of Ethernet type connecting them to the ground calculator (not shown). An antenna 7 per track (responsible for the activation of the transponders during their going past the neighbourhood of said antennas as well as responsible for the transmission of the transponder identifiers towards the reading module per se of the reader) here is sunk in one of the carrying tracks CT12, CT11. This example so shows a clever achievement in order to place the reader 6 nearby a section track by connecting it to an antenna 7 placed with a transversal shift in comparison with a median longitudinal axis of the track and for which the transponders (in pair or in rows of more than two transponders for example) are identically placed with a transversal shift in comparison with the median longitudinal axis of the vehicle.

Figure 4:
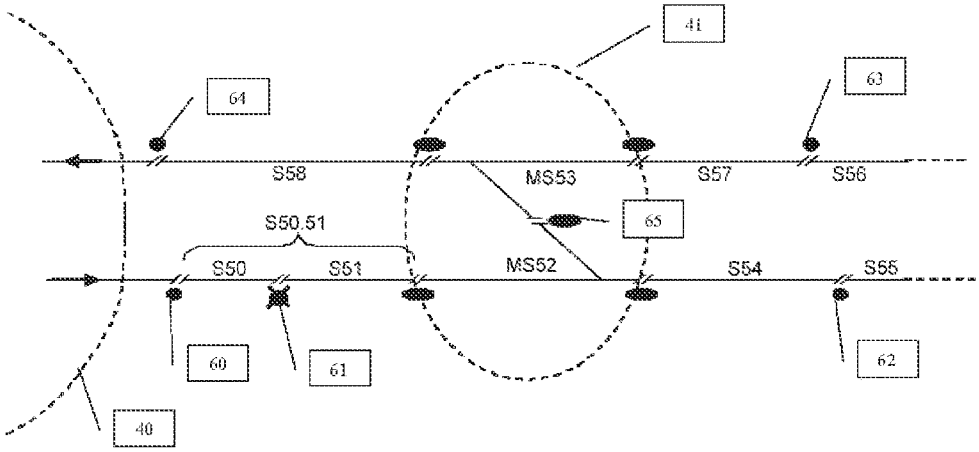

FIG. 4 represents a layout of readers and transponders in a zone comprising two manoeuvre sections according to the invention and comprises a typical section with double tracks of a rail network, with a zone non equipped 40 and a manoeuvre zone 41 ensuring a link between the two tracks.

The two tracks and the link are divided in sections S50, S51, MS52, MS53, S54 to S58. The ends of the two manoeuvre sections MS52, MS53 are equipped with five transponder readers 65 controlled to ensure a topnotch safety and to ensure a high availability. Other transponder readers 60 to 64 are only controlled for safety ends.

The calculator (not shown) here has detected a default on the reader 61 and thus can for safety and availability reasons merge the sections S50 and S51 in a sole section S50.51.

Figure 5:
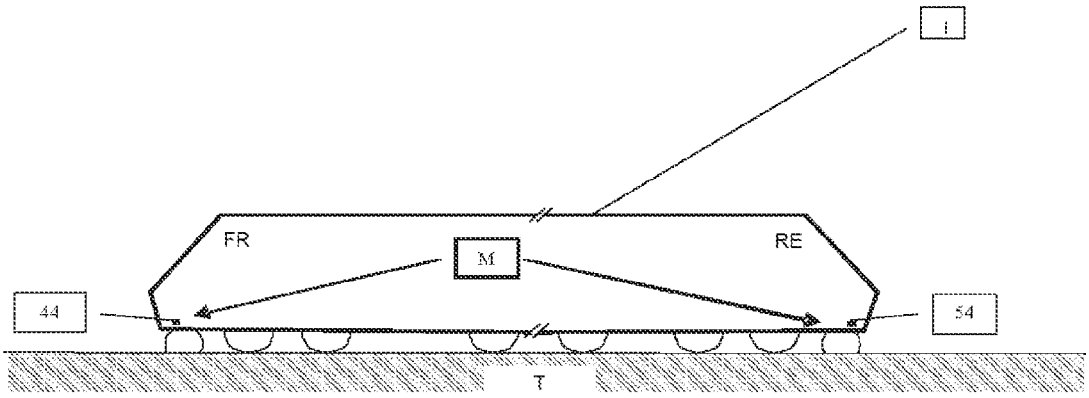

FIG. 5 presents the second achievement mode of a system for determining the movement properties of a train on a track T according to the invention (side view in comparison with the track) for which an equipment M is designed on board the train 1 as subsidiary means for determining the moving direction (or the polarity) intervening by a coding of the means of identification of two only transponders 44, 54 placed at the "front" and "rear" ends of the train 1. By interaction of the transponders with at least one reader and subsidiary equipment, the polarity of the train that way can be determined. Analogically, if the equipment delivers the polarity, the moving direction can then be determined thanks to the transponders.

The invention claimed is:

1. A system for determining movement properties of a vehicle guided along a section of track appropriate for a signaling track control, comprising:

at least four on-board transponders mounted in pairs on the vehicle, with two transponders of each pair being aligned parallel to a longitudinal axis of the vehicle, with at least one pair downstream and at least one pair upstream of the vehicle and providing distinct identification;

at least one reader for said transponders disposed on the ground at each end of the section; and a ground calculator communicating with said readers, said ground calculator being configured to determine, during a passing of at least two transponders of the vehicle, a moving direction and an intrinsic front/rear orientation of the vehicle relative to the track.

2. The system according to claim 1, which comprises at least one additional transponder disposed at a front of the vehicle and at least one additional transponder disposed at a rear of the vehicle to ensure a redundant number of transponders.

3. The system according to claim 1, wherein said reader disposed nearby a track section is linked to an antenna placed with a transversal shift in comparison with a median longitudinal axis of the track and wherein said transponders are placed with a transversal shift in comparison with a median longitudinal axis of the vehicle.

4. The system according to claim 1, wherein said transponders are aligned according to a longitudinal median axis of the vehicle and wherein two respective said readers have antennas placed successively according to the longitudinal median axis of the vehicle nearby each end of the track section.

5. The system according to claim 1, which comprises additional transponders mounted on the vehicle to form rows of transponders.

6. The system according to claim 5, wherein said transponders and said additional transponders are disposed in rows along each side of the vehicle at the front and at the rear of the vehicle.

7. The system according to claim 5, wherein each row comprises two or three transponders successively aligned along the vehicle.

8. The system according to claim 1, wherein said transponders are RFID tags.

9. The system according to claim 1, wherein the vehicles are supported on pneumatic tires, on iron wheels, or by magnetic levitation.

10. A system for determining movement properties of a vehicle guided along a track section appropriate for a signalling track control, comprising:

at least two on-board transponders mounted on the vehicle, each placed downstream and upstream of the vehicle and delivering predefined identification of the vehicle, of the front and of the rear of the vehicle;

means for determining a moving direction intervening by a coding of the identification by the transponders;

at least one reader for reading the transponders disposed stationary at one end of the section; and a ground calculator communicating with said at least one reader and determining, during a passing of at least one transponder of the vehicle, a moving direction thereof and an intrinsic front/rear orientation of the vehicle relative to the track.

11. The system according to claim 10, wherein said means for determining the moving direction of the vehicle is an on-board movement calculator or a movement measuring device.

12. The system according to claim 10, wherein said transponders are RFID tags.

13. The system according to claim 10, wherein the vehicles are supported on pneumatic tires, on iron wheels, or on magnetic levitation wheels.

* * * * *